US006673709B2

(12) United States Patent
Jaslier et al.

(10) Patent No.: US 6,673,709 B2
(45) Date of Patent: Jan. 6, 2004

(54) FORMATION OF AN ALUMINIDE COATING, INCORPORATING A REACTIVE ELEMENT, ON A METAL SUBSTRATE

(75) Inventors: Yann Jaslier, Melun (FR); Alain Martinez, Massy (FR); Marie-Christine Ntsama Etoundi, Charenton (FR); Guillaume Oberlaender, Paris (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 09/938,500

(22) Filed: Aug. 27, 2001

(65) Prior Publication Data

US 2002/0023696 A1 Feb. 28, 2002

(30) Foreign Application Priority Data

Aug. 28, 2000 (FR) ..... 00 11000

(51) Int. Cl.[7] ..... H01L 21/44

(52) U.S. Cl. ..... 438/610; 438/762; 438/763; 438/785; 438/793; 438/794; 428/620

(58) Field of Search ..... 438/610, 758–763, 438/793–794, 785; 118/715, 50, 620.41; 428/620; 427/523

(56) References Cited

U.S. PATENT DOCUMENTS

| | | | | | |
|---|---|---|---|---|---|
| 3,951,642 | A | | 4/1976 | Chang et al. | |
| 3,979,273 | A | | 9/1976 | Panzera et al. | |
| 4,071,638 | A | | 1/1978 | Chang et al. | |
| 4,310,574 | A | | 1/1982 | Deadmore et al. | |
| 5,407,705 | A | * | 4/1995 | Vakil | 427/255 |
| 5,510,008 | A | * | 4/1996 | Sekhar et al. | 205/384 |
| 5,824,423 | A | | 10/1998 | Maxwell et al. | |
| 5,902,638 | A | | 5/1999 | Vakil | |
| 5,958,204 | A | * | 9/1999 | Creech et al. | 204/487 |
| 6,033,623 | A | | 3/2000 | Deevi et al. | |
| 6,126,758 | A | * | 10/2000 | Meelu et al. | 148/258 |
| 6,284,058 | B1 | * | 9/2001 | Santella et al. | 148/242 |
| 6,361,680 | B1 | * | 3/2002 | Sekhar et al. | 205/385 |
| 6,406,561 | B1 | * | 6/2002 | Creech et al. | 148/242 |
| 2002/0031683 | A1 | * | 3/2002 | Lavery et al. | 428/668 |
| 2002/0110698 | A1 | * | 8/2002 | Singh | 428/472 |

FOREIGN PATENT DOCUMENTS

| | | |
|---|---|---|
| DE | 198 24 792 | 12/1999 |
| EP | 0 386 386 | 9/1990 |
| FR | 2 529 911 | 1/1984 |
| GB | 943 278 | 12/1963 |
| GB | 2 285 632 | 7/1995 |

OTHER PUBLICATIONS

Derwent Abstracts, Accession No. 1990–183901, SU 1 527 320 A, Dec. 7, 1989.

Derwent Abstracts, Accession No. 1977–89645Y, SU 541 896, Mar. 16, 1977.

Derwent Abstracts, Accession No. 1993–033661, KR 9 202 707, Mar. 31, 1992.

Derwent Abstracts, Accession No. 1986–207956, JP 61–139677, Jun. 26, 1986.

Patent Abstracts of Japan, JP 60–103177, Jun. 7, 1985.

* cited by examiner

*Primary Examiner*—Matthew Smith
*Assistant Examiner*—Grandvill D. Lee
(74) *Attorney, Agent, or Firm*—Oblon, Spivak, McClelland, Maier & Neustadt, P.C.

(57) ABSTRACT

The reactive element is introduced to the surface of the metal substrate in the form of an oxide powder and the aluminide-type coating is then formed.

20 Claims, No Drawings

FORMATION OF AN ALUMINIDE COATING, INCORPORATING A REACTIVE ELEMENT, ON A METAL SUBSTRATE

BACKGROUND OF THE INVENTION

The invention relates to the formation on a metal substrate of a protective coating of the aluminide type incorporating at least one reactive element.

The field of application of the invention is that of the production or repair of metal components which, because of their use at high temperatures and in an oxidizing medium, must be provided with a protective coating.

The invention is especially, but not exclusively, applicable to gas turbine components, in particular to components of the hot parts of turbojets.

To optimize their operation, it is endeavoured to make gas turbines, especially turbojets, operate at the highest possible temperatures.

The components exposed to these temperatures are usually made of a refractory metal alloy, or superalloy, based on nickel or cobalt.

In order to improve their high-temperature behaviour, in particular their corrosion and oxidation resistance, it is well known to form a protective coating on the superalloy metal substrate.

Among the constituent materials of such a protective coating, aluminide-type coatings, which especially allow the development of a protective alumina film on their surface, are commonly used.

Aluminization by cementation is the technique used most often to form aluminide-type coatings. This technique generally consists in placing the metal substrate in a closed chamber containing a cementation agent and in raising the assembly to a temperature usually between 900°C. and 1150° C.

The aluminide-type coatings can be used by themselves, or in combination with an external coating forming a thermal barrier, such as a ceramic coating. In the latter case, the aluminide-type coating constitutes a bond coat between the substrate and the external coating, attachment of the latter being favoured by the presence of the alumina film forming an adhesion layer.

To increase the lifetime of the alumina-film-generating aluminide and to limit its deterioration by spalling it is known to incorporate into the aluminide-type coating at least one reactive element usually chosen from the group consisting of zirconium, yttrium, hafnium and the lanthanides.

Such a reactive element reinforces the diffusion barrier function with respect to elements of the metal substrate which are liable to affect the alumina film, and it therefore favours the integrity and the persistence of the latter. The presence of the reactive element also results in a reduction in the rate of oxidation of the metal substrate and prevents the segregation, which is highly undesirable, of sulphur at the interface with a ceramic external coating.

Various processes have been proposed for forming an aluminide-type coating incorporating a reactive element.

A first type of known process consists in alloying or combining separately the reactive element with one or more constituents of the coating and in forming the latter by a process involving physical deposition on the metal substrate.

For example, reference may be made to the document U.S. Pat. No. 4,055,705 which describes the formation of a bond coat by the plasma spraying or sintering of NiCrAlY or depositing it using another physical technique. Reference may also be made to the document FR 96/15257 which describes the deposition, by electrophoresis, or in the form of a paint with a thermally degradable or volatile binder, of an MCrAlY (M being Ni and/or Co and/or Fe) alloy powder on a metal substrate. Electroplating an alloy containing a metal of the platinum group is then carried out before heat treatment and possible aluminization. Reference may also be made to the document U.S. Pat. No. 5,824,423 which, although envisaging the initial deposition of a reactive element on a metal substrate by physical vapour deposition followed by aluminization, preferably indicates the formation of a bond coat by the plasma spraying of an MAlY (M being Ni and/or Co and/or Fe) pre-alloyed powder.

These types of known processes require a further step of adding the reactive element to an alloy. This may require major investment.

Reference may also be made to the documents SU 1 527 320 and SU 541 896 which describe the application to the surface of a metal substrate of a suspension containing aluminium and zirconium powders and a binder, such as a varnish in solution, in order to obtain a protective coating after drying and heat treatment.

However, the handling of elements such as zirconium in divided form is particularly difficult because of the high risk of spontaneous reaction with the air.

A second type of known process consists in forming an aluminium coating incorporating a reactive element by chemical vapour deposition (CVD). Reference may be made to the document U.S. Pat. No. 5,503,874 which describes the alternating deposition of an aluminium layer and a metal oxide layer, such as yttrium oxide, zirconium oxide, chromium oxide or hafnium oxide, from organometallic precursors. A heat treatment allows the oxide to be reduced by the aluminium. Reference may also be made to the document U.S. Pat. No. 5,989,733 which describes the formation of a coating by the chemical vapour deposition of the elements Al, Si, Hf and possibly Zr, or another reactive element, preceded or followed by the electroplating of Pt, in order to obtain a modified nickel aluminide.

These types of known processes require the use of a chemical vapour deposition plant, which is expensive both in terms of investment and maintenance.

A third type of known process makes use of the aluminization technique, but by modifying it with the incorporation of the reactive element into the cementation agent. Reference may be made to the document FR 2 511 396 which proposes the use of a cementation agent containing aluminium, an aluminium alloy, an activator salt and a reactive element.

SUBJECT AND SUMMARY OF THE INVENTION

It is an object of the invention to provide a process allowing an aluminide-type coating incorporating at least one reactive element to be formed on a metal substrate in a simple and inexpensive manner.

This object is achieved by the fact that, according to the invention, the process comprises the steps which consist in:

- introducing the said reactive element to the surface of the metal substrate in the form of a powder of the oxide of the reactive element; and
- then forming the aluminide-type coating.

Introducing the reactive element in the form of a powder of the oxide of this element makes it possible to avoid difficulties in handling a powder of the reactive element.

The reactive element may be introduced to the surface of the metal substrate by coating with a composition containing the powder mixed with a liquid, or by spraying such a composition, or by spraying the powder on the substrate so that it becomes encrusted in its surface, or else by electrophoresis.

The process according to the invention is noteworthy in that, despite introducing the reactive element in pulverulent form, an aluminide-type coating is obtained whose microstructure and effectiveness are completely comparable to those of the similar coatings of the prior art, whereas the method of implementation of the process proves to be particularly advantageous.

This is because the process does not require expensive equipment to be installed or maintained.

The reactive element is furthermore introduced as close as possible to the metal substrate, thereby optimizing the efficiency between mass of reactive element involved and doping of the coating thus formed.

In addition, it is possible for the mass of reactive element introduced to be controlled precisely and over a very wide range.

Furthermore, the process allows the reactive element to be introduced into localized regions of the surface of the substrate, for example for the purpose of repairing a protective coating. This is not possible with the processes of the prior art, in which the reactive element is deposited in the gas phase or incorporated in a cementation agent.

The aluminide-type coating may be formed by aluminization after introducing the reactive element to the surface of the substrate. No modification to the known aluminization processes, apart from possibly the duration, is necessary. This constitutes yet another advantage of the process.

As a variant, the aluminide-type coating may be formed by depositing the constituents of the coating after the reactive element has been introduced to the surface of the substrate, and heat treatment in order to make the constituents react together.

Again as a variant, at least the aluminium is furthermore introduced to the surface of the metal substrate in the form of powder and then the aluminide-type coating is formed by heat treatment. The reactive element and the aluminium may be introduced to the surface of the substrate by coating or spraying with a liquid composition comprising a powder of the reactive element in oxide form, an aluminium powder and a binder, the coating or spraying being advantageously carried out in superposed layers in order to achieve a thickness according to that of the desired aluminide-type coating.

According to yet another variant of the process, at least one metal chosen from the group consisting of platinum, palladium, rhodium and ruthenium is furthermore deposited on the surface of the substrate.

The aluminide-type coating formed by the process according to the invention may be used by itself, or as a thermal barrier sublayer, an external coating made of ceramic then being formed which anchors to an alumina film generated at the interface between the aluminide-type coating and the ceramic external coating.

The invention also relates to metal substrates, especially gas turbine components made of a superalloy, which are provided with aluminide-type coatings as obtained by the above process.

The invention will be more clearly understood from reading the detailed description given below by way of indication, but implying no limitation.

DETAILED DESCRIPTION OF METHODS OF IMPLEMENTATION

The process according to the invention is intended more particularly, but not solely, for the production of aluminide-type protective coatings on metal substrates made of a superalloy, especially a superalloy based on nickel or cobalt, such as metal substrates of gas turbine components, particularly turbojet components.

According to one characteristic of the invention, at least one reactive element that has to be present in the aluminide-type coating is introduced to the surface of the substrate, prior to the formation of the coating, in the form of a powder of an oxide of the reactive element.

The reactive element is preferably chosen from zirconium, yttrium, hafnium and the lanthanides.

Depositing these reactive elements in the form of an oxide powder makes it possible to avoid difficulties in handling these elements which react on contact with the air.

Several simple techniques may be used to deposit the oxide powder on the surface of the substrate.

A first technique consists in preparing a composition containing the powder and a liquid, and in coating the surface of the metal substrate, or a selected part of this surface, with this composition. The liquid used is, for example, a resin to which a solvent may optionally be added. This makes it possible, after the resin has optionally been cured, to fix the powder to the surface. The coating process may be carried out very conventionally using a brush.

As a variant, such a composition containing the powder and a liquid may be sprayed onto the surface or onto a selected part thereof.

Another technique that can be used consists in spraying only the powder onto the surface of the substrate, or onto a selected part thereof. The spraying is carried out by giving the powder particles sufficient energy for them to be able to become encrusted in the surface of the substrate.

Yet another technique consists in depositing the powder on the surface of the substrate by electrophoresis. This is a technique well known per se, a brief description of which may be found in the above-mentioned document FR 96 15257.

It should be noted that, before introducing the oxide powder to the surface of the substrate, an optional initial step of the process may consist in forming, on the surface of the substrate, a coating made of a precious metal chosen from platinum, palladium, rhodium and ruthenium. Such a metal coating may be formed, in a manner known per se, by sputtering or by electroplating, a diffusion heat treatment then being often carried out. As a variant, such a coating with a metal from the platinum group could be formed after introducing the powder of the oxide of an active element to the surface of the substrate.

The next step of the process consists in forming the aluminide-type coating.

Advantageously, a conventional cementation aluminization process is employed.

Pack cementation, with contact between a cementation powder and the substrate, consists in varying the latter in a powder containing (i) an aluminium alloy, generally a chromium-aluminium alloy, (ii) an inert constituent, such as alumina, in order to prevent sintering, and (iii) a halogen-containing activator (for example, $NH_4Cl$, $NH_4F$, $AlF_3$, NaF, NaCl, etc.) which makes it possible to transfer the metal to be deposited between the cementation agent and the substrate. The assembly is raised to a temperature of, for example, between 900° C. and 1150° C. in a furnace.

The cementation may also be carried out without contact with the substrate, the cementation agent being provided elsewhere in the furnace. In the latter case, the halogen-containing activator may be incorporated into the cementation agent or may be introduced separately into the furnace.

During the aluminization, the oxide of the reactive element, introduced beforehand to the surface of the substrate, may be at least partially reduced. When the oxide is dispersed in a resin, the latter is rapidly degraded by the halides formed by the activator element and by the heat.

Thermochemical reactions take place between the halides, the cementation agent, the oxide of the reactive element and the metal alloy of the substrate which make it possible to form the aluminide coating and to disperse the reactive element within the aluminide coating formed. With a substrate made of a nickel-based superalloy, a nickel aluminide containing the reactive element is obtained.

Processes other than aluminization may be used to form the aluminide-type coating. For example, constituents of the desired coating may be deposited on the substrate by physical vapour deposition processes, such as sputtering or plasma spraying, or chemical vapour deposition processes using gaseous precursors. These processes are known per se. Reference may be made, for example, to the documents GB 2 005 729, U.S. Pat. No. 5,741,604 and U.S. Pat. No. 5,494,704. The constituents may be deposited as superposed alternating layers. A heat treatment is used to obtain the desired aluminide with possible reduction of the oxide introduced beforehand to the surface of the substrate and dispersion of the liberated reactive element within the coating.

According to yet another variant, a hybrid coat, consisting of a powder of the oxide of the reactive element and aluminium powder is deposited on the surface of the metal substrate. The coat may be deposited by a coating or spraying process using a composition containing the oxide powder, the aluminium powder and an inorganic or organic binder, such as a resin optionally diluted in a solvent. Several superposed layers are formed according to the thickness of the coating to be produced. A heat treatment is then carried out at a temperature of preferably between 800° C. and 1100° C. in order to form an aluminide by diffusion from the metal substrate and the dispersion of the reactive element within the coating.

The metal substrate may be used just with the aluminide coating providing protection against corrosion and oxidation at high temperatures.

It is also possible to add an external coating made of ceramic, for example zirconia, yttrium oxide or yttriated zirconia. This external coating, obtained by a physical deposition process such as, for example, sputtering, thermal spraying or electron beam evaporation, constitutes a thermal barrier. The function of the aluminide-type intermediate coating is then especially to act as a bond coat allowing attachment of the ceramic external coating via an alumina film formed on the surface of the bond coat.

Examples of methods of implementing the process will now be described by way of indication, but implying no limitation.

EXAMPLE 1

A metal substrate made of a nickel-based superalloy was provided with a coating made of a zirconium-doped nickel aluminide in the following manner.

A zirconia powder having a mean particle size of 14 $\mu$m was mixed with a liquid acrylate resin in an amount of 1 part by weight of powder per 8 parts by weight of resin. The mixture was applied to the substrate by coating it with a brush and then the resin was cured by exposure to UV.

A contactless cementation aluminization operation was then carried out by placing the substrate in a furnace in the presence of a cementation agent and an activator. The cementation agent was composed of 30 wt % aluminium and 70 wt % chromium and the activator used was $NH_4Cl$. The aluminization was carried out at a temperature of approximately 1100° C. for a time of approximately 4 h 30 min. The acrylate resin was rapidly degraded by the halides formed and by the heat, while the zirconia was reduced.

Thus, a substrate made of a nickel-based superalloy with a nickel aluminide coating containing 0.9 wt % zirconium was obtained.

EXAMPLE 2

A metal substrate made of a nickel-based superalloy was blasted with a zirconia powder identical to that of Example 1. The blasting allowed zirconia particles to be deposited on and encrusted in the surface of the substrate.

A contactless cementation aluminization operation was then carried out as in Example 1. The nickel aluminide obtained had a zirconium content of a few hundred ppm, with a fine dispersion of alumina particles having a size of less than one micron.

EXAMPLE 3

A metal substrate made of a nickel-based superalloy was coated with several layers of aluminizing paint. This paint consisted of the dispersion, in an inorganic binder, of a mixture of zirconia powder, aluminium powder, and silicon powder in respective proportions by weight of 8%, 82% and 10%. The layers were formed by coating the paint and were deposited in succession with intermediate drying in air supplemented with an oven treatment at 90° C. for 30 min. The number of layers was chosen according to the thickness of the aluminide coating desired.

The metal substrate was then placed in a furnace in order for it to undergo a heat treatment at 1000° C. in an inert atmosphere (argon). A nickel aluminide coating was obtained by diffusion, in which zirconium was dispersed.

As already indicated, depositing an oxide of the reactive element by a coating or spraying process is advantageous in that it makes it possible to form this coat on only part of the surface of the metal substrate. The most exposed critical parts of the substrate, or those parts of the substrate which require repair to the aluminide-type coating or to the optional external ceramic coating, may therefore be chosen.

Although in the above examples the deposition of a zirconia powder was envisaged, the process may be implemented in a similar manner using an yttrium oxide powder, a hafnium oxide powder, a lanthanide oxide powder or a mixture of two or more of these powders.

What is claimed is:

1. A process comprising:

depositing a liquid composition on a surface of a metal substrate; and forming an aluminide coating on the substrate coated with the liquid composition;

wherein the liquid composition comprises a powder of an oxide of a reactive element.

2. The process according to claim 1, wherein said depositing is spraying the liquid composition onto the surface.

3. The process according to claim 1, wherein the aluminide coating is formed by aluminization.

4. The process according to claim 1, wherein the aluminide coating is formed by depositing the aluminide coating after the reactive element has been deposited on the surface of the metal substrate and a heat treatment has been carried out, in order to make the aluminide coating and reactive element react together and to disperse the reactive element within the aluminide coating.

5. The process according to claim 1, further comprising depositing at least aluminium in pulverulent form on the surface of the metal substrate, and the aluminide coating is formed by heat treatment.

6. The process according to claim 5, wherein the at least one reactive element and aluminium are introduced to the surface of the metal substrate in the liquid composition, and said liquid composition further comprises an aluminium powder and a binder.

7. The process according to claim 6, wherein the liquid composition is deposited on the surface of the metal substrate as several superposed layers thereby achieving a thickness of the desired aluminide coating.

8. The process according to claim 1, wherein the at least one reactive element is selected from the group consisting of zirconium, yttrium, hafnium and the lanthanides.

9. The process according to claim 1, further comprising depositing at least one metal selected from the group consisting of platinum, palladium, rhodium and ruthenium on the surface of the metal substrate.

10. The process according to claim 1, wherein an external coating of ceramic is formed on top of the aluminide coating.

11. The process according to claim 1, wherein the aluminide coating is formed on a localized area of the surface of the metal substrate.

12. A process comprising:

depositing a reactive element selected from the group consisting of zirconium and lanthanides on the surface of a metal substrate in the form of a powder of the oxide of the reactive element; and forming an aluminide coating on the substrate.

13. A coated metal substrate comprising an aluminide coating having at least one reactive element and formed on the surface of the substrate, prepared by the process of claim 12.

14. The coated metal substrate according to claim 13, wherein the protective coating further comprises an external coating of ceramic anchored to the aluminide coating.

15. The coated metal substrate according to claim 13, wherein the aluminide-type coating further comprises at least one metal selected from the group consisting of platinum, palladium, rhodium and ruthenium.

16. A gas turbine component comprising the coated metal substrate of claim 13, wherein the metal substrate comprises a superalloy.

17. The process of claim 12, wherein said depositing is by spraying the powder of the oxide of the reactive element onto the surface of the substrate, thereby encrusting the surface of the substrate with the powder of the oxide of the reactive element.

18. The process of claim 12, wherein said depositing is by electophoresis.

19. The process of claim 12, wherein said depositing is carried out by coating a liquid composition comprising the powder of the oxide of the reactive element onto the surface of the substrate.

20. The process of claim 12, wherein said depositing is carried out by spraying a liquid composition comprising the powder of the oxide of the reactive element onto the surface of the substrate.

* * * * *